United States Patent [19]

Bacro

[11] 3,945,545

[45] Mar. 23, 1976

[54] METHOD AND APPARATUS FOR FORMING A YARN WEB ON A CONVEYOR

[75] Inventor: Bruno Bacro, Ribemont, France

[73] Assignee: Societe Nouvelle de la Teinturerie de la Chaussee Romaine, St. Quentin, France

[22] Filed: Sept. 23, 1974

[21] Appl. No.: 508,353

[30] Foreign Application Priority Data

Sept. 27, 1973 France ..... 73.34627

[52] U.S. Cl. ..... 226/97; 28/1 CL; 28/1 SM; 19/155; 226/196

[51] Int. Cl.[2] ..... B65H 17/32

[58] Field of Search ..... 226/7, 97, 118, 199, 196; 19/155; 28/1 CL, 1 SM, 74 R

[56] References Cited

UNITED STATES PATENTS

| | | | |
|---|---|---|---|
| 2,736,676 | 2/1956 | Frickert | 19/155 X |
| 2,928,121 | 3/1960 | Plumbo | 28/1 SM X |
| 3,296,678 | 1/1967 | Bundy | 28/1 SM |
| 3,511,625 | 5/1970 | Pitt | 28/1 SM X |
| 3,605,225 | 9/1971 | Gibson | 28/74 R X |

*Primary Examiner*—Richard A. Schacher
*Attorney, Agent, or Firm*—Toren, McGeady and Stanger

[57] ABSTRACT

Yarn is fed pneumatically through a flexible tube having a delivery end which oscillates transversely over a conveyor. The yarn leaving the delivery end of the tube strikes a transverse deflector and is deposited randomly and without tension to form a web on a conveyor belt. The web is then printed and the printed yarn subsequently collected.

5 Claims, 5 Drawing Figures

METHOD AND APPARATUS FOR FORMING A YARN WEB ON A CONVEYOR

BACKGROUND OF THE INVENTION

The invention relates to the formation of a yarn web on a conveyor, and in particular to the formation of such a web in a printing installation, in which the web passes through a printing head, then through a heat treatment zone for fixing the dyestuff.

A particular aim of the invention is the formation of a web, well suited for carrying out the various treatments to which it must be subjected.

Another aim of the invention is to provide for easy recovery of the yarn on completion of the operations carried out on the web.

The invention is also aimed at avoiding, during application of the print, the formation of "images" or patterns on the fibre, i.e. the avoidance of regular repeats of colour applied to the finished product, which may be knitted or woven.

BRIEF DESCRIPTION OF THE INVENTION

The process according to the invention is characterised in that the yarn in the form of a single thread or a plurality of threads is conveyed pneumatically in a tube and continuously projected from the end of said tube, on to a deflector, which extends laterally above the conveyor, and on leaving said deflector, the yarn material falls freely, under gravity and without tension on to the conveyor, being deposited in random manner, the tube being traversed in order that the thread sweeps the deflector over at least a part of its width.

The apparatus according to the invention is characterised in that it consists of: feed means for supplying the yarn; a tube through which the yarn passes, the inlet of the tube being located close to the feed means and the outlet of which being located close to the conveyor; means for circulating compressed air through the tube to the outlet; a deflector or baffle extending laterally above the conveyor and designed to be struck by the thread projected from the tube outlet; and means for traversing the end of the tube in order to project the thread randomly against a section of at least the width of the deflector, the arrangement being such that the thread is conveyed pneumatically through the tube, strikes the deflector to leave same to fall freely under gravity and without tension on to one section at least of the width of the conveyor in random manner.

According to one embodiment of the invention, the delivery end of the tube is attached to a device which traverses over the width of the conveyor, the deflector being planar.

According to another embodiment, the thread is projected from the tube backwards with respect to the direction of travel of the conveyor.

DESCRIPTION OF PREFERRED EMBODIMENTS

Other embodiments of the invention will be described in more detail below in conjunction with the drawings in which.

Figure 1:
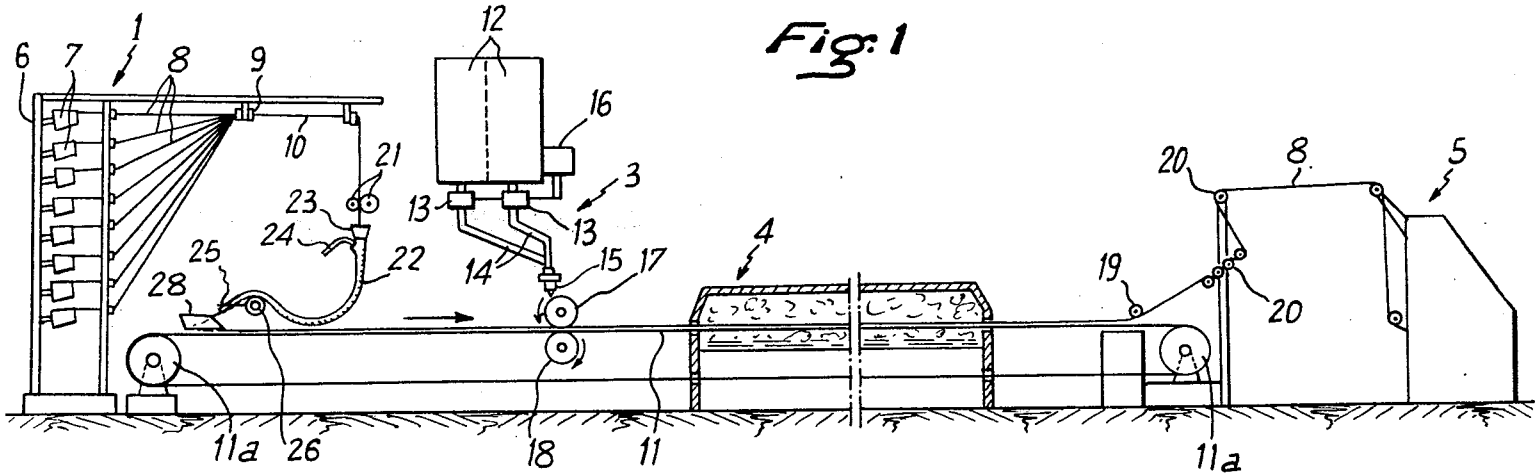
FIG. 1 shows a scematic diagram, partly sectioned, of an apparatus according to one embodiment of the invention.

The following description will be with reference to the application of the invention for printing a yarn web, the yarn being present in the form of a bundle; of course the invention is by no means restricted to this mode of application nor to the use of a bundle of threads.

The apparatus comprises: a station 1, at which the yarn threads are supplied; a station 2 in which the yarn web is formed on an endless conveyor 11, rotating over rolls 11a; a printing station 3; a heating station 4; and a delivery station 5 for collecting the treated yarn.

The station 1 includes a creel 6 carrying yarn packages 7. The yarn threads 8, initially separate, are collected in a thread guide 9 to form a non- intertwined bundle 10. The thread bundle passes through another guide 9 before reaching the station 2 where the web is formed.

The printing station 3, includes in known manner, overhead tanks 12, each controlled by an electric valve 13. From each valve a tube 14 leads to a nozzle 15 for ejecting dye liquor at low pressure. The nozzles 15 are directed transversely to the conveyor which they overhang.

The valves 13 are controlled according to a predetermined programme via a control unit 16. The tanks 12 contain various colours/dyes, from which, with the aid of the control unit 16, any sequence of colours can be obtained, with or without repetition.

The dye liquor issuing from the nozzles 15 falls under gravity. According to a preferred embodiment, the dye liquor does not fall directly on to the belt 11 but on to a smooth roller 17, idle and driven by the belt 11; this roller operating in conjunction with a lower idle roller 18, located beneath the belt, so that the belt 13 and the web deposited at zone 2 will be nipped between the two rollers.

The dye liquor falls on to the roller 17 upstream of its axis; thus the dye liquor is deposited on to the web just prior to the nip point of the rollers. During passage of the web through the rollers, the liquor penetrates into the yarns to effect a thorough dyeing. Nevertheless some spreading of the dye occurs and this is why the belt is used, preferably perforated such as wire mesh, for example of stainless steel, so that any possible surplus of dye liquor can leave the upper surface of the belt thereby preventing the accumulation of dye liquor on this surface. Similarly, a cylinder 17 of different construction may be used, in known manner.

On leaving the printing station 3, the web passes into the heating station 4 for fixing and drying the dye. This equipment is standard and will not be described. On leaving the station 4, the web may be washed to remove additives and dried in air. These operations will not be described.

The printed and dried web then passes through a guide 19 and over a series of guiding rollers 20 before entering the station 5 which comprises a conventional winding mechanism. The rollers 20 and the winding mechanism divide the sheet 10 into its separate threads 38 which are then wound separately.

Various embodiments of the station 2, where the web is formed, will now be described. In these embodiments, the bundle 10, after leaving the last guide 9, is entrained by the feed rolls 21 to enter a flexible tube 22. The entry end of the tube is in the form of a funnel 23 and its delivery end, in the vicinity of the belt 11, is supported by a traversing device. The yarn is conveyed pneumatically through the tube 22. For this purpose, compressed air from a tube 24 is fed into the tube 22 close to the funnel; the tube 24 terminates in the tube 22 parallel with the thread bundle 10 such the air is directed to the delivery end and while circulating through the tube, it entrains the thread bundle.

Figure 2:
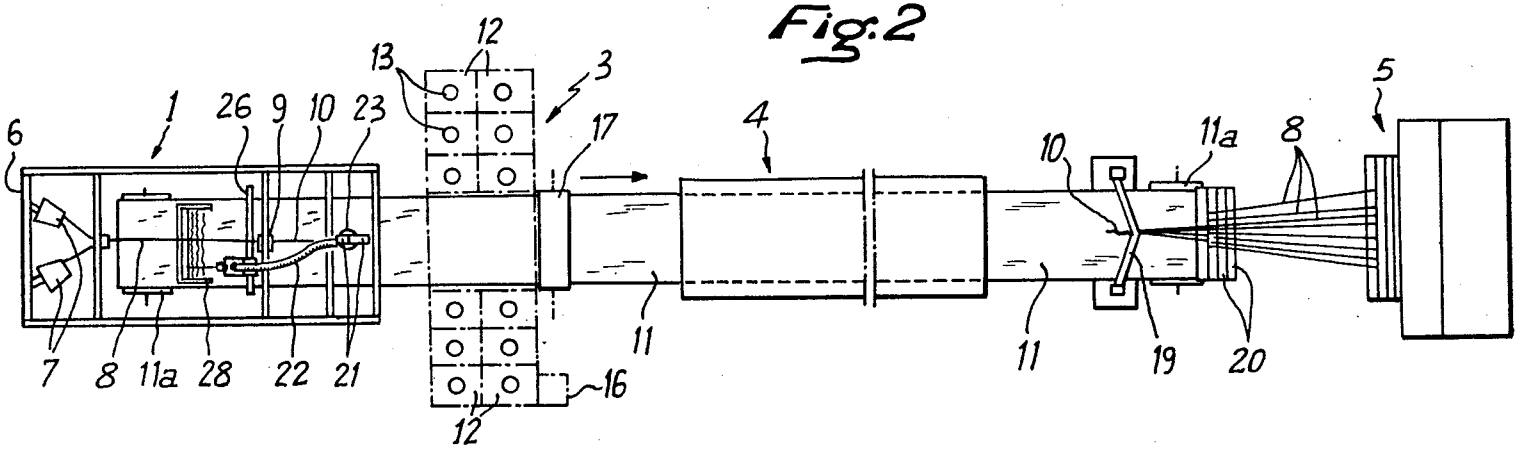
FIG. 2 is a plan view of the apparatus of FIG. 1.
Figure 3:
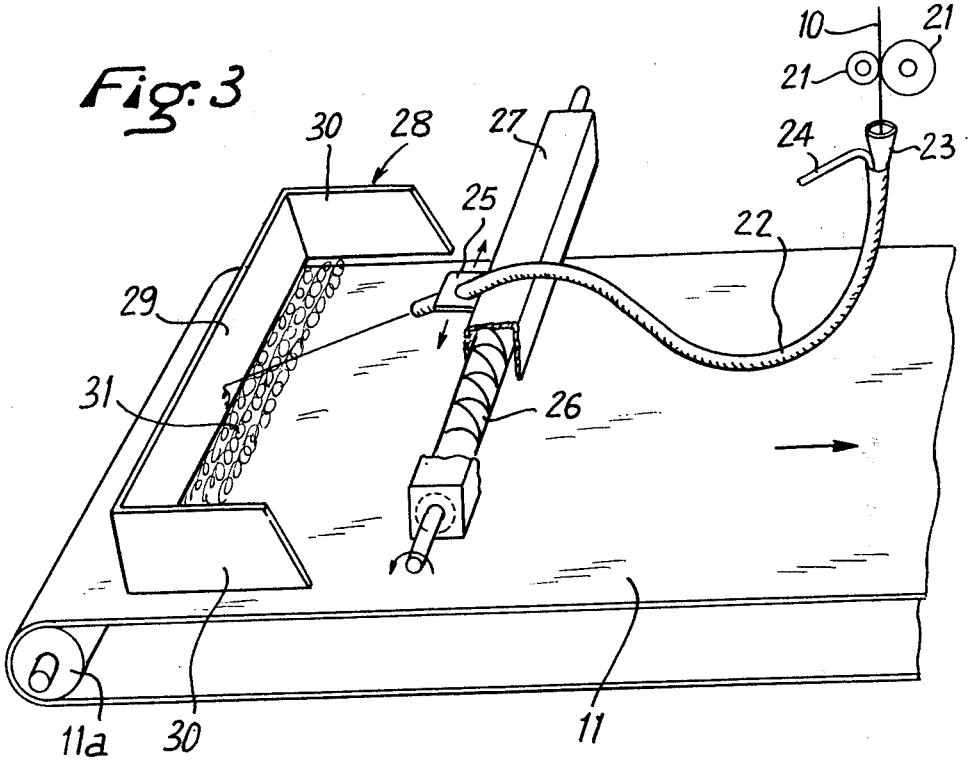
FIG. 3 is a perspective view on a larger scale, illustrating the apparatus for producing the web, used in the apparatus of FIGS. 1 and 2.

In the embodiment illustrated in FIGS. 1 to 3, the delivery end of the tube 22 is supported on a traverser 25 which engages a lead screw 26 having both right and left hand threads and driven with uniform rotation. The screw is located transversely above the belt 11. A cover 27 prevents the transverser from being caused to rotate with the screw. In this manner, the traverser undergoes a rectilinear movement to and fro across the belt and the delivery end of the tube 22 undergoes the same movement in parallel thereto. From the end of the tube, the thread bundle 10 is projected obliquely at the belt 11; in its path, a fixed deflector 28 is provided, for example, of a plastics material and comprising a plate 29 with two lateral cheeks 30 and which is held above the belt 11. The plate 29 is planar and extends transversely across the belt over a width slightly less than the width of the belt; it is inclined slightly to the vertical such that its face which meets the thread bundle is sloping upwards. The cheeks 30 extend forwards from the ends of the plate 29.

As shown in FIGS. 1 to 3, the station where the web is formed incorporates a flexible tube 22 for projecting the thread bundle 10 backwards with respect to the direction of movement of the belt 11. On striking the plate 29, the thread bundle loses its kinetic energy and falls freely under gravity and without tension on to the belt, which is moving, thereby forming a web 31. The plate 29 is situated at a distance from the belt so that the air projected from the tube 22 can dissipate in the gap thus provided without disturbing the web 31. As shown in FIG. 3, the thread bundle is deposited in spirals or loops in random manner which obviates any possibility of patterning in the final product. Moreover, the thread bundle is deposited in an untangled manner, thereby allowing for easy recovery in the station 5. As it is deposited, the web 31 is advanced between the cheeks 30, as indicated by the arrow. The speed of advance of the belt, the feed of the yarns as well as the movement of the transverser 25 and the flow and pressure of the compressed air are determined according to the type of yarns used and the thickness of the web required.

Figure 4:
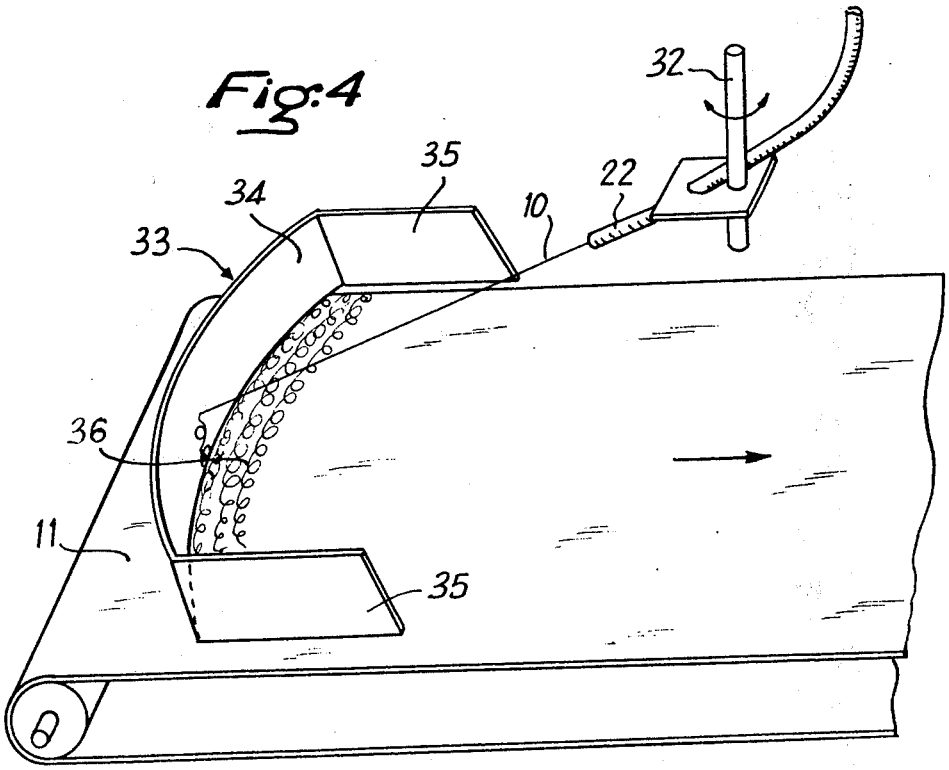
FIG. 4 is a perspective view in detail, showing an arrangement according to one variant.

The embodiment shown in FIG. 4 differs from the preceding one by the shape of the deflector and by the movement of the delivery end of the flexible tube 22. This end is fixed to a vertical shaft 32 driven with an alternating angular motion. In order that the threads bundle 10 will strike the deflector 33 at a constant height with respect to the belt 11, the plate 34 is given a cylindrical shape, such that its axis intersects the rotational axis of the shaft 32 near the delivery end of the tube 22. As before, two lateral cheeks 35 are attached to the ends of the central plate 34. In this manner, the resultant web 36 comprises a succession of arcuate rows of spirals.

Figure 5:
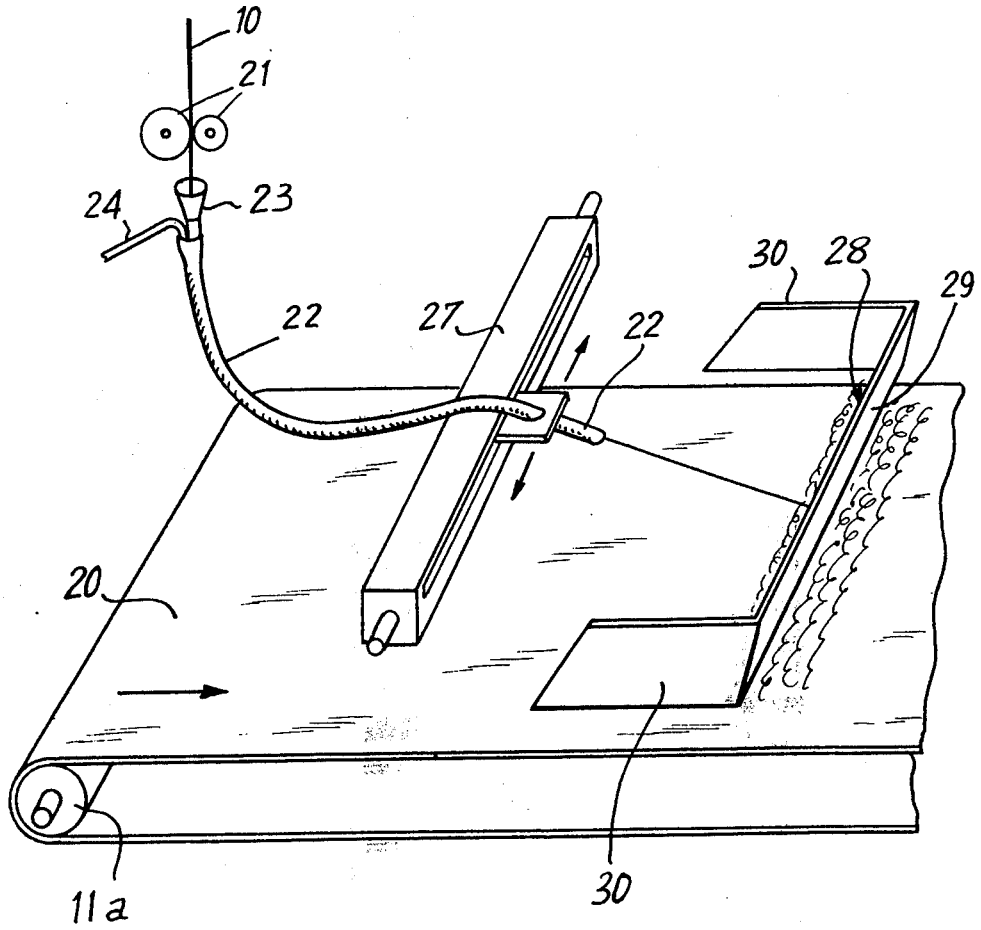
FIG. 5 is a perspective view, also in detail, showing the apparatus of FIGS. 1 to 3 arranged in different layout.

It will be seen that by projecting the thread bundle 10 rearwardly with respect to the belt movement 11 (FIGS. 1 to 4), a doubling of the spirals over themselves is obtained at the time they are deposited, such that they are easy to unravel. However, in certain applications at least, it is possible to project the thread bundle forwards and to pass the web beneath the deflector. Such an embodiment is illustrated in FIG. 5 and may, for example, embody the same means as those of FIG. 3 but arranged differently. The delivery end of the tube 22 faces forwards and is located upstream of the deflector, the cheeks 30 of which are directed upstream. The deflector 28 is located higher above the belt 11 than shown in FIG. 3 in order that in the space provided, not only the air projected through the tube can dissipate but also that the web 37 can pass beneath the deflector during its formation.

In one embodiment of the invention, the deflector serves the role of a leveller in that it prevents the yarn from making pointed and elongated loops, the latter creating very great printing anomalies and also difficulties at the re-winding station at the output of the fixing station. It goes without saying that this mode of operation may be used equally well with the arrangement illustrated in FIG. 4.

What I claim is:

1. Apparatus for producing a yarn web comprising yarn supply means for feeding therefrom yarn in a longitudinal direction, an elongated tubular guide member having a hollow interior through which said yarn passes, said tubular guide member including an entry end through which yarn is introduced thereinto and a delivery end from which said yarn is emitted, said tubular guide member being formed from flexible material throughout its length at least between said entry end and said delivery end, means holding said entry end fixed relative to said yarn supply means to enable feeding of yarn therefrom into said entry end, a horizontal planer conveyor moving in a given linear direction beneath said delivery end for having said yarn emitted from said delivery end accumulated thereon to form said yarn web, pneumatic means for injecting compressed air flow through said tubular guide member toward said delivery end for projecting said yarn through said guide member and out of said delivery end, a fixed deflector plate located proximate said delivery end above said horizontal conveyor and arranged to be upstanding therefrom in a generally vertical arrangement, said fixed plate including a central wall extending across said conveyor transversely of said given linear direction of movement and a pair of end walls entending generally parallel to said given direction, and traversing means having said delivery end mounted thereon to direct said yarn emitted therefrom to impinge said fixed deflector plate at an angle extending generally obliquely to said conveyor, said traversing means operating to move said delivery end to reciprocally horizontally vary the direction in which said yarn is emitted therefrom across said conveyor in directions transversely of said given direction of movement to distribute said yarn upon said conveyor.

2. Apparatus according to claim 1 wherein said traversing means comprise a lead screw extending across said conveyor substantially perpendicularly to said given direction of movement, and a traverser member threadedly engaging said lead screw and having said delivery end of said tubular guide member fixed thereto, said lead screw having thereon threaded means to effect reciprocal transverse movement of said traverser member and said delivery end across said conveyor upon rotation of said lead screw, said central wall of said deflector plate comprising a configuration which extends generally linearly across said conveyor.

3. Apparatus according to claim 1 wherein said traversing means comprise a vertically extending rod mounted for rotation about a fixed vertical axis, means mounting said delivery of said tubular guide member upon said rod to effect angular movement of the direction in which said delivery end extends with rotation of said rod, said rod being arranged to reciprocally rotate within fixed angular limits to aim said delivery end at said deflector plate with the direction in which said delivery end is aimed being reciprocated across said conveyor, and wherein said central wall of said fixed deflector plate is formed in a semi-circular cylindrical configuration having a center of revolution which is coincident with said fixed vertical axis of rotation of said rod.

4. Apparatus according to claim 1 wherein the delivery end of said tubular guide member is directed rearwardly taken relative to said given linear direction of movement of said conveyor.

5. Apparatus according to claim 1 wherein the delivery end of said tubular guide member is directed forwardly taken relative to said given linear direction of movement of said conveyor.

* * * * *